United States Patent [19]

Gaillard et al.

[11] Patent Number: 4,946,138

[45] Date of Patent: Aug. 7, 1990

[54] ROUNDWOOD HIGHWAY GUARDRAILS

[75] Inventors: Christian Gaillard; Thierry Papineschi, both of Beziers, France

[73] Assignee: Compagnie Francaise des Etablissements Gaillard, Beziers, France

[21] Appl. No.: 275,148

[22] Filed: Nov. 22, 1988

[30] Foreign Application Priority Data

Nov. 27, 1987 [FR] France ..... 87 16682

[51] Int. Cl.[5] ..... A01K 3/00

[52] U.S. Cl. ..... 256/13.1; 256/19; 256/65; 403/388; 248/66

[58] Field of Search ..... 256/13.1, 64, 65, DIG. 6, 256/19, 59; 403/388; 248/66

[56] References Cited

U.S. PATENT DOCUMENTS

| | | | |
|---|---|---|---|
| 2,785,876 | 3/1957 | McKenzie | 256/19 |
| 3,178,780 | 4/1965 | Booher | 403/260 |
| 4,142,711 | 3/1979 | Brimhall | 403/346 X |
| 4,722,513 | 2/1988 | Gaillard | 256/13.1 |

FOREIGN PATENT DOCUMENTS

| | | |
|---|---|---|
| 883394 | 5/1980 | Belgium . |
| 184525 | 6/1986 | European Pat. Off. . |
| 228334 | 7/1987 | European Pat. Off. . |
| 1223749 | 6/1960 | France . |
| 1262476 | 2/1972 | United Kingdom . |

*Primary Examiner*—Andrew V. Kundrat
*Assistant Examiner*—Franco S. DeLiquori
*Attorney, Agent, or Firm*—Bucknam and Archer

[57] ABSTRACT

Road safety guardrails are constituted by vertical wooden posts carrying at least one horizontal rail made up of wooden logs which are connected end-to-end by pairs of metal straps which are interconnected by bolts, each passing through both straps and one or other of the logs. Each inter-log connection is reinforced by incorporating metal rods that run through each log and intersect the diametrical plane containing the bolts for interconnecting the straps.

9 Claims, 7 Drawing Sheets

Fig. 1
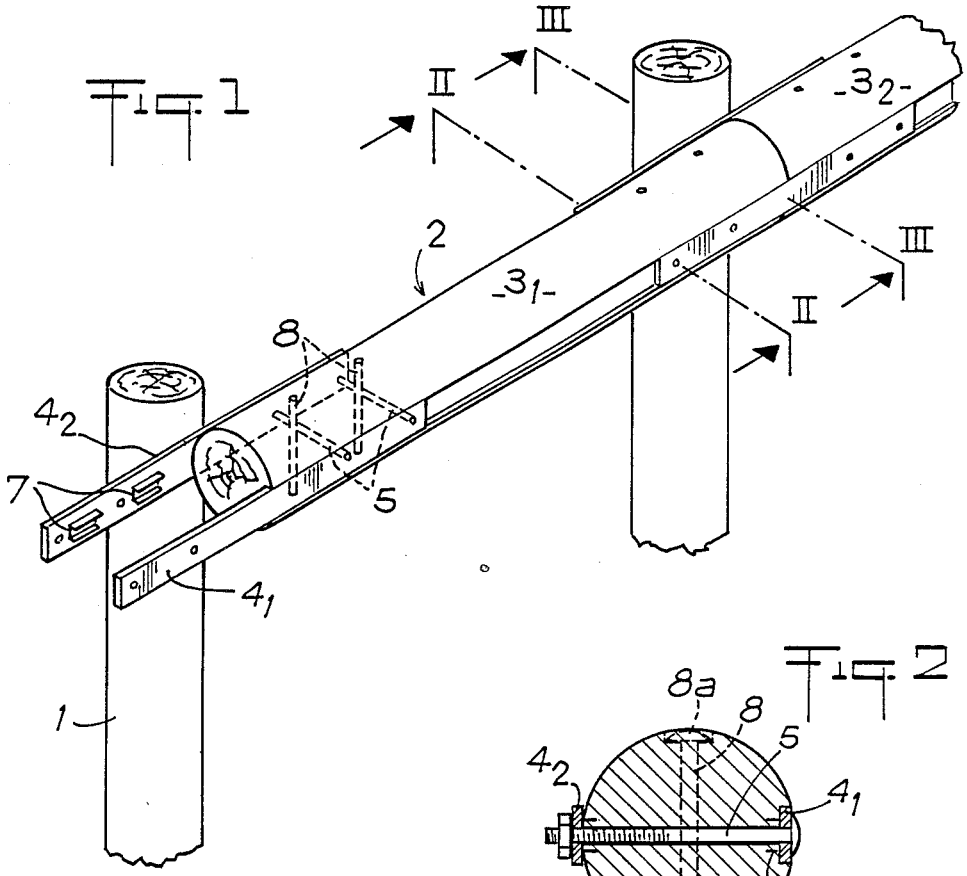
Fig. 2
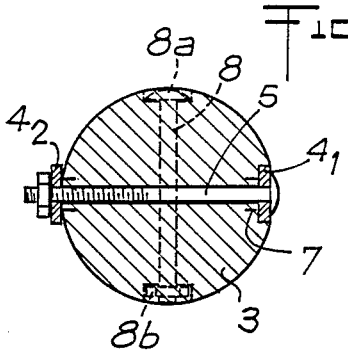
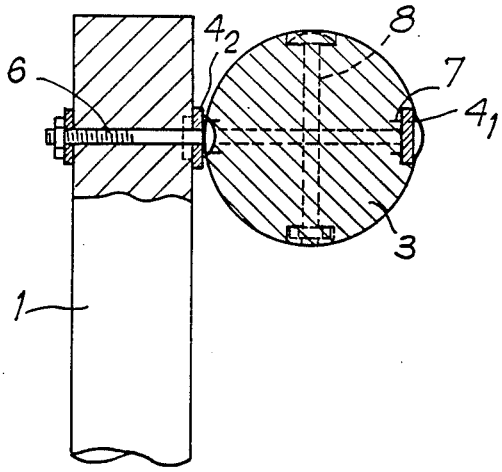
Fig. 3

FIG. 4
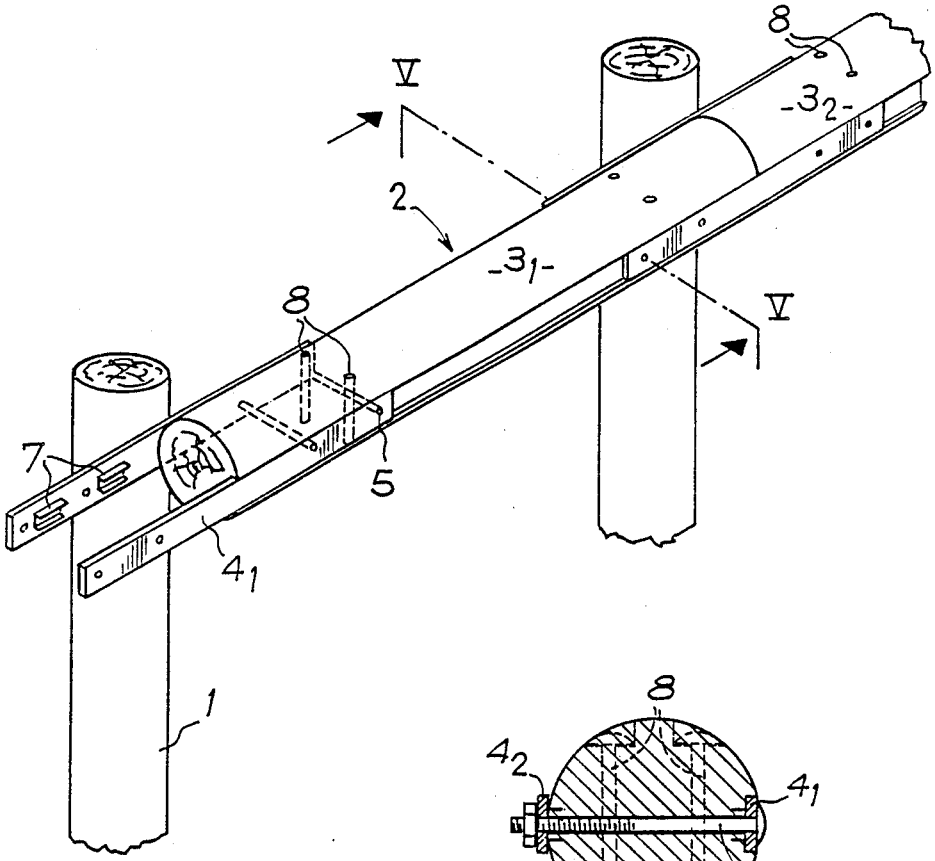
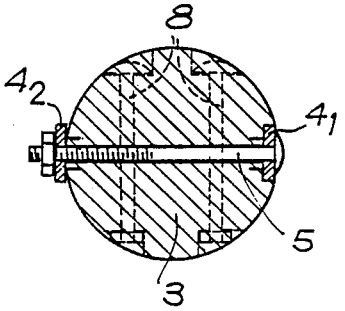
FIG. 5

FIG. 6
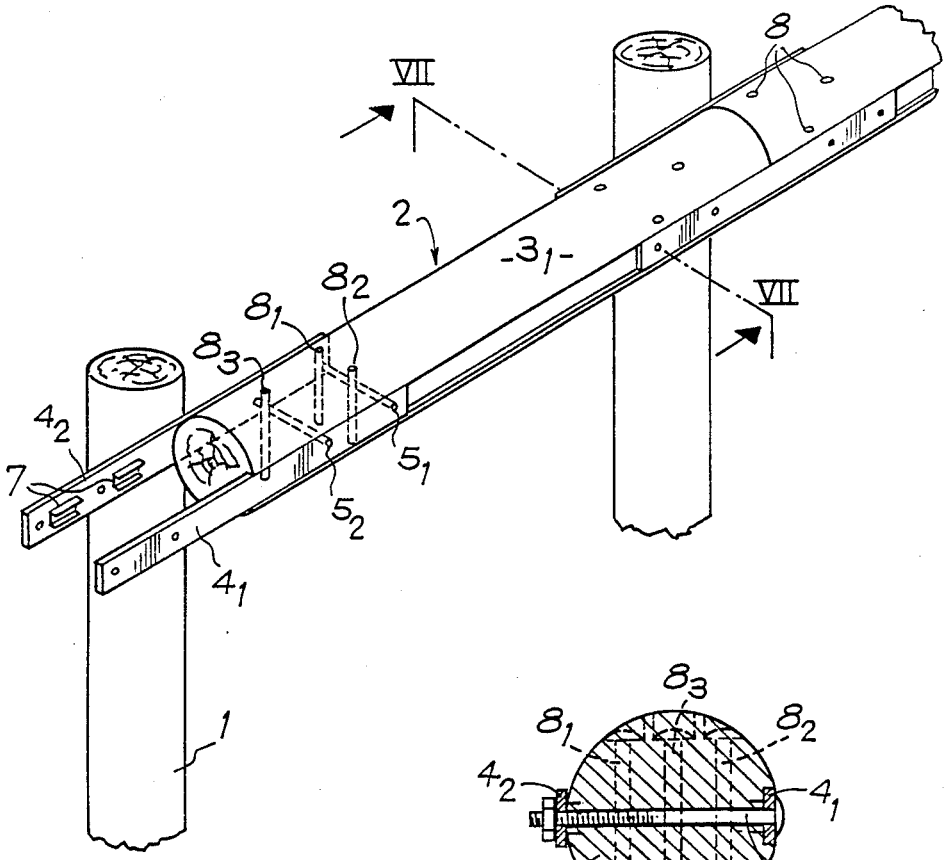
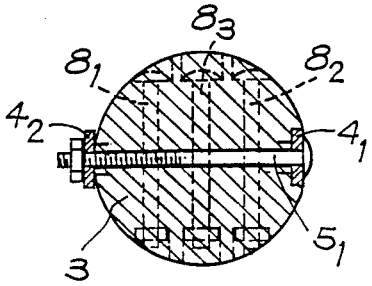
FIG. 7

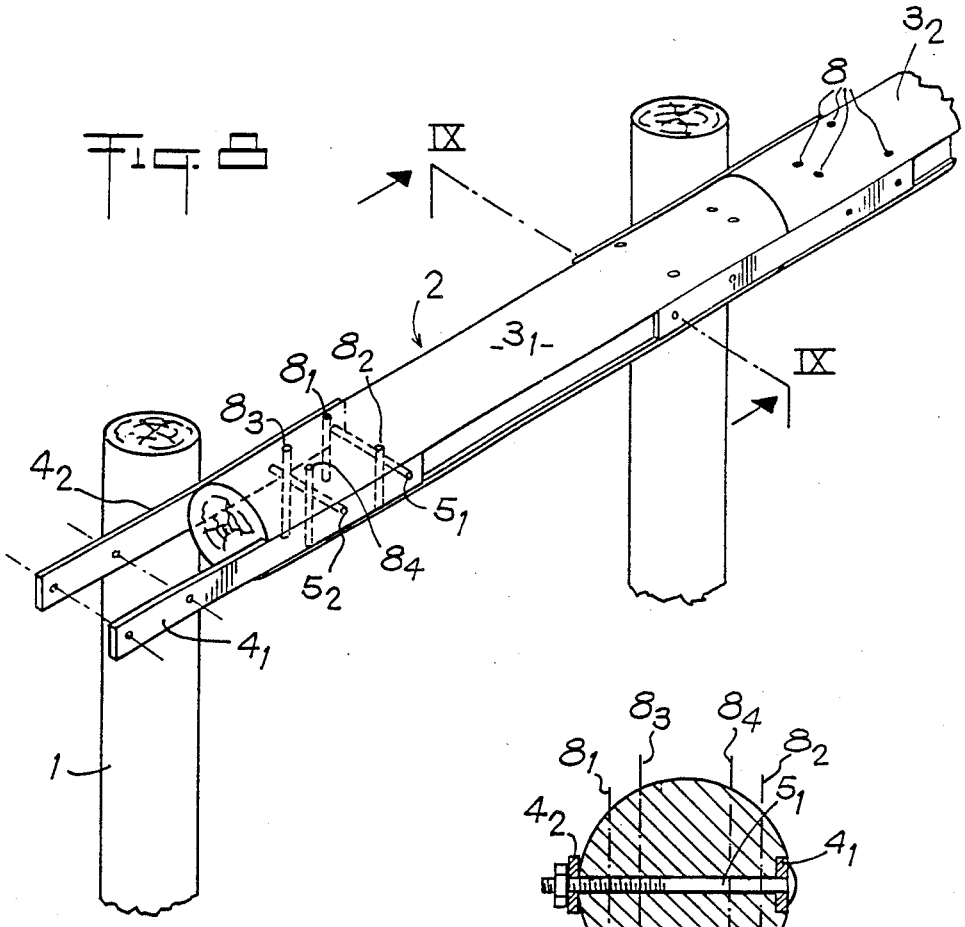
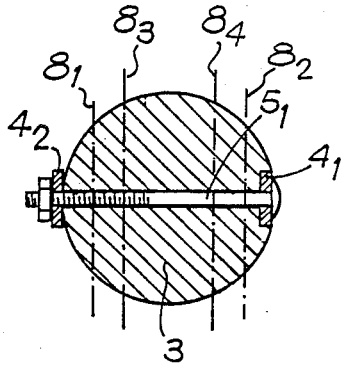
FIG. 9

Fig. 10
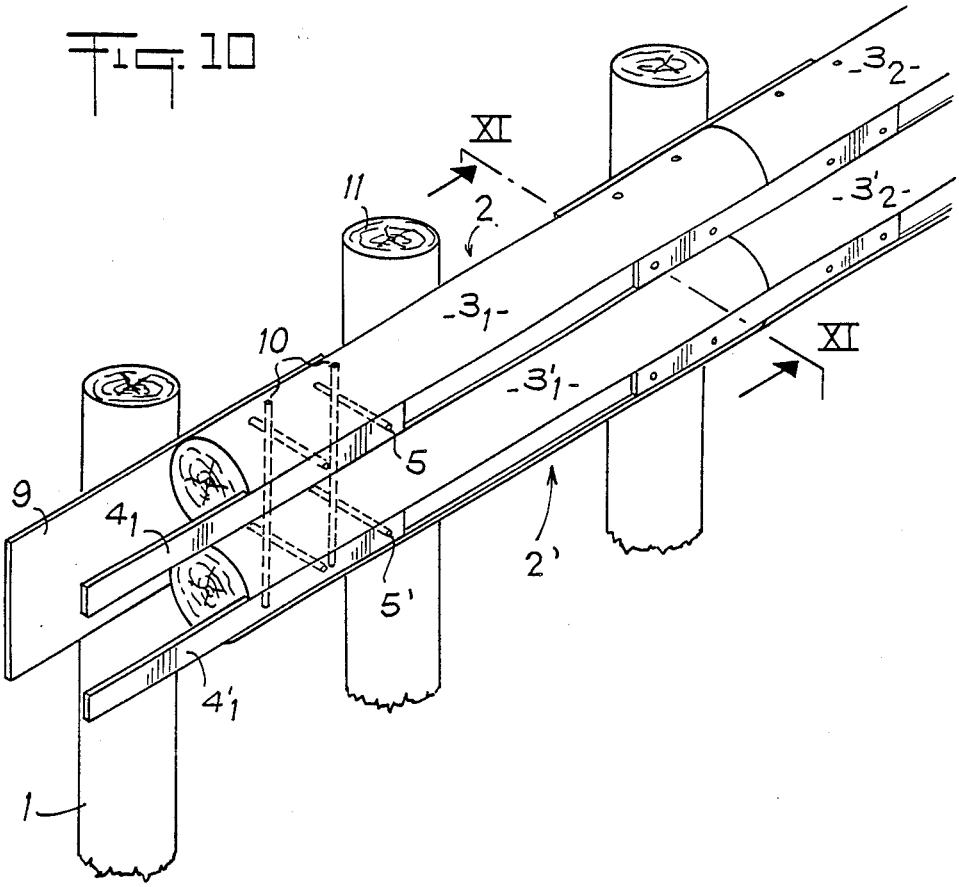
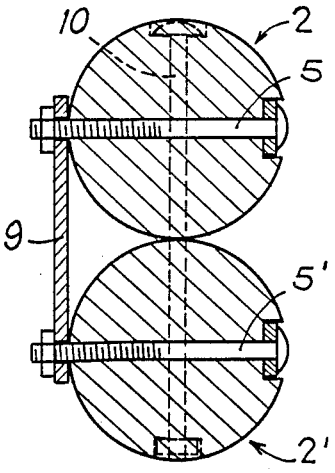
Fig. 11

ROUNDWOOD HIGHWAY GUARDRAILS

The present invention relates to safety guardrails made of roundwood and intended to be placed along roads or expressways.

FIELD OF THE INVENTION

The technical field of the invention is the construction of road safety devices.

BACKGROUND OF THE INVENTION

Metal guardrails are known which are placed along roads and which constitute safety barriers. Safety guardrails made of wood are also known.

U.S. Pat. No. 2 085 058 (Wood), U.S. Pat. No. 1 493 088 (Van Epps), and U.S. Pat. No. 3 989 226 (Burgess) describes safety barriers including rails made of rectangular section wood.

European patent application No. 0 184 525 (85.420202.5) (Eynard) describes road safety guardrails comprising a rail made of wooden logs assembled end-to-end by T-shaped metal reinforcements and by wooden posts.

European patent application No. 0 228 334 (86.430049.6) (Compagnie Francaise des Etablissements Gaillard) also describes road safety guardrails comprising roundwood posts and roundwood rails assembled end-to-end by pairs of metal straps which advantageously include spikes on their inside faces for penetrating into the rails.

The present invention relates to improvements to the safety guardrails described in said published European patent application No. 0 228 334.

The problem to be solved is the following:

Wooden guardrails must satisfy specifications which require assembled rails to have a given traction strength, for example a strength of 200 kilonewtons (i.e. about 20 (long) tons), so that in the event of an impact from a vehicle, the rails do not run the risk of coming apart, thereby allowing the vehicle to pass through them.

Statistical testing performed on samples of logs held together by pairs of straps which are interconnected by bolts have shown that the horizontal diametrical plane in which the bolts are located constitutes a plane of weakness and also that the measured traction strengths have a wide degree of dispersion about the mean value, namely about 10%. As a result it is difficult to meet traction strength specifications without excessively increasing the diameter of the logs from which the rails are made up.

The problem is thus to improve safety barriers including at least one rail made up of roundwood logs assembled end-to-end in such a manner as to increase the static traction strength of the connections between logs by using reinforcing means which are simple and cheap, so as to enable wooden guardrails to remain competitive in price.

In addition to their static traction strength, road safety barriers must also meet specified dynamic behavior requirements. In the event of impact from a vehicle, the connections between the component parts must enable a large amount of overall lengthening to take place without breaking so as to absorb the kinetic energy of the vehicle.

An object of the present invention is therefore to improve the end-to-end connection between logs in order to confer high static traction strength thereto while still enabling considerable elongation to occur at the connections situated on either side of an impact to occur in the event of impact from a vehicle.

Belgium patent No. 883 394 (Yves Durand) describes end-to-end connections between rectangular section beams comprising both assembly bolts passing through a plurality of juxtaposed beams or passing through a single beam and two connection straps, together with reinforcing members constituted by two plates which are clamped against the sides of each beam at the ends thereof by threaded rods passing through the beams and running perpendicular to the assembly bolts. Such reinforcing members compress the wood situated in the zones through which the assembly bolts pass.

Reinforcement by such plates is not suitable for interconnecting logs in a safety guardrail since such reinforcement necessarily requires plates and rod ends to project proud above and below the logs and this would be highly dangerous for the safety of passengers in the vehicles. In addition, the plates which compress the wood cannot be used out-of-doors because the wood will swell due to variations in humidity and this will loosen the clamping plates and make them ineffective.

Finally, when the plates are clamped together to compress the wood, the assembly becomes rigid and in the event of impact from a vehicle, it is capable of elongating by a small amount only.

SUMMARY OF THE INVENTION

The present invention provides a road safety guardrail of conventional type comprising wood posts carrying at least one horizontal rail made up of wood logs which are connected end-to-end by pairs of metal straps which are interconnected by bolts each of which passes through both straps and one of the logs, with said bolts lying in the horizontal diametrical plane of the logs, wherein each connection between two successive logs is reinforced by incorporating metal rods in each log, said rods passing through the log and being placed at least in the immediate proximity of said bolts on the same sides of the bolts as the closest join between logs, with said rods intersecting said horizontal diametrical plane.

Advantageously, the metal reinforcing rods are threaded rods or bolts.

In a preferred embodiment, the reinforcing rods are vertical.

Each bolt interconnecting two metal straps may be associated with a single metal reinforcing rod which is then placed in the vertical diametrical plane of the log. It is also possible to associate each of the bolts interconnecting two metal straps with two metal reinforcing rods which are disposed symmetrically about the vertical diametrical plane of the log. Combined solutions may also be used in which a single reinforcing rod is associated with one of the bolts and two rods are associated with the other bolt.

It is also possible to reinforce the traction strength by constituting safety guardrails in accordance with the invention comprising two identical rails which are superposed and in contact with each other, with the rails being mechanically connected to each other by a single plate situated on the side facing away from the road, with said plate being connected by the horizontal bolts to two straps situated on the road side of the rails.

In this case, the connections between the successive logs in each of the rails may also be reinforced by vertical metal rods associated with each bolt.

Advantageously, each vertical rod may pass through two superposed logs so as to participate in providing the mechanical connection between the two superposed rails.

The result of the invention is to provide wooden road safety guardrails whose traction strength and whose impact strength is considerably improved by the addition of the reinforcing rods which are incorporated in the logs, i.e. by means which are cheap in material and in the work required for installation.

Statistical measurements have shown, other things being equal, that traction strength is more than doubled by adding such reinforcing metal rods. These rods may be incorporated in the logs in the factory, thereby enabling said operation to be mechanized and thus reducing its cost.

Alternatively, the bores for receiving the reinforcing rods may be drilled in the factory at the same time as the bores for receiving the bolts for interconnecting the straps, and the reinforcing rods may be put into place on site at the same time as the assembly bolts. A maximum number of bores may be provided and the number of reinforcing rods actually installed may be adapted to the specifications of each particular utilization.

The embodiment comprising two superposed rails which are in contact with each and which are mechanically bound together at least by a common assembly plate and optionally by reinforcing rods passing through pairs of superposed logs makes it possible to construct wooden guardrails having good mechanical properties and, in particular, very good traction strength, while simultaneously reducing the number of interconnections and thus reducing the cost of the construction.

BRIEF DESCRIPTION OF THE DRAWINGS

Various embodiments of the invention are described by way of example with reference to the accompanying drawings, in which:

FIGS. 1, 2, and 3 are respectively a perspective view and two cross-sections through a first embodiment of a guardrail in accordance with the invention;

FIGS. 4 and 5 are respectively a perspective view and a section through a second embodiment;

FIGS. 6 and 7 are respectively a perspective view and a section through a third embodiment;

FIGS 8 and 9 are respectively a perspective view and a section through a fourth embodiment;

FIGS. 10 and 11 are respectively a perspective view and a cross-section through a first embodiment of a guardrail comprising two superposed horizontal rails;

MORE DETAILED DESCRIPTION

Figure 12:
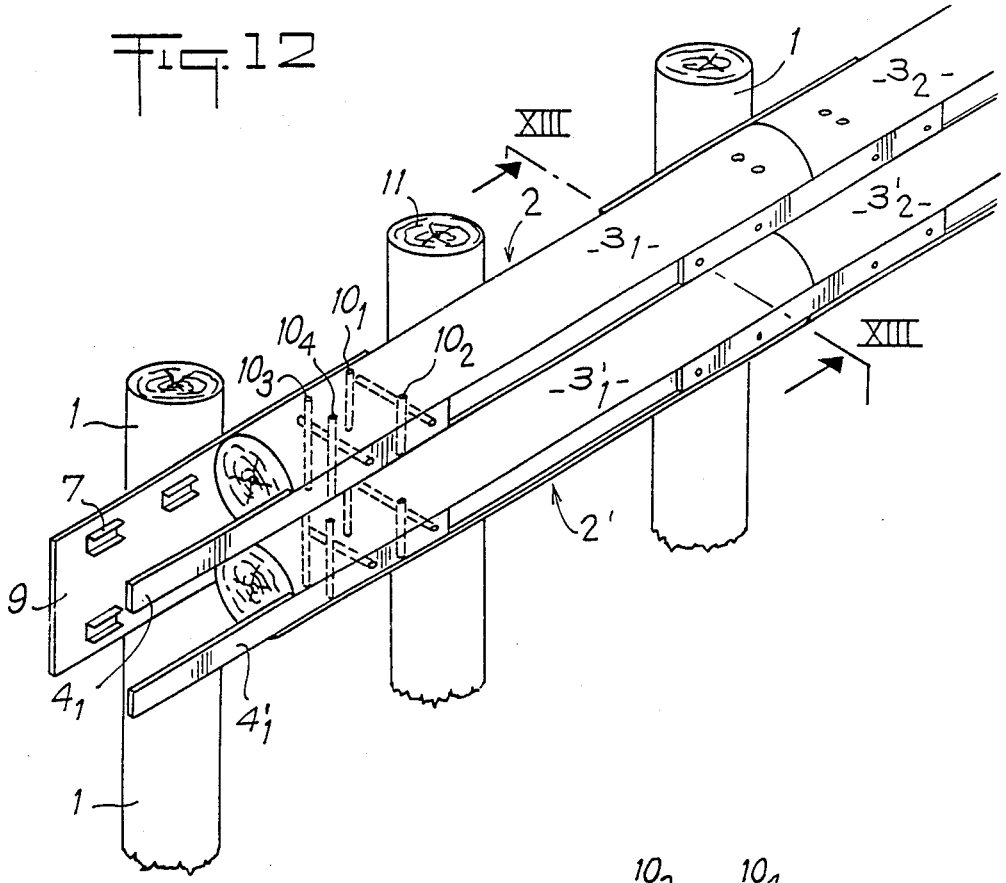
FIGS. 12 and 13 are respectively a perspective view and a cross-section through a second embodiment of a guardrail comprising two superposed horizontal rails.

FIG. 1 is a perspective view of a length of guardrail in accordance with the invention comprising roundwood posts 1 carrying a horizontal rail 2 which is made up of wood logs $3_1$, $3_2$, . . . etc. . . . which are interconnected end-to-end by pairs of horizontal metal straps $4_1$, $4_2$ placed on either side of the ends of a pair of adjacent logs and which are themselves interconnected by means of bolts 5 extending across the horizontal diametrical plane of the logs, with each bolt passing both of the straps and one of the logs.

In a preferred embodiment, each connection comprises four bolts 5, with two bolts passing through each log.

Advantageously, the logs $3_1$, $3_2$ are of constant diameter and the strap $4_1$ is placed in a horizontal groove provided in the logs.

The posts 1 are placed at the joins between pairs of logs 3 and the rail is assembled to the posts 1 by bolts 6 which pass through the rear strap $4_2$ and the post 1, as can be seen in FIG. 3.

The straps $4_1$ and $4_2$ may include metal spikes 7 on their inside faces for the purpose of penetrating into the wood.

Guardrails as described above are known and are described in published European patent application No. 0 228 334.

The interconnections between the logs must be strong enough for there to be no danger of them breaking when a vehicle strikes the rail at high speed.

Specifications lay down tests of mechanical strength.

In France, for example, the rails must be capable of withstanding a traction force of about 200 kilonewtons (about 20 (long) tons).

Tests performed on guardrails as described above have shown that if an assembled rail is subjected to a traction force, the horizontal diametrical plane in which the bolts 5 lie is a plane of weakness since the wood fibers situated in this plane are subjected to compression and traction forces which are larger than those to which other fibers situated outside said plane are subjected, so that said other fibers contribute less to overall strength.

Statistical measurements of traction strength performed on numerous samples also show a wide dispersion of results about the mean, with differences of about 10% about the mean value.

According to the present invention, the end-to-end connections of rail components are reinforced by incorporating metal rods 8 in the ends of each log, with said rods 8 being of similar diameter to the bolts 5.

The rods 8 are advantageously threaded rods or bolts.

Each rod 8 passes right through a log. Each rod 8 is placed at least in the immediate proximity of one of the bolts 5 (i.e. it may be in contact therewith) and on the side thereof which is closest to the nearest join between two logs, i.e. the join which is held together, in part, by the bolts 5 in question, such that when traction is exerted on the straps, each bolt 5 is drawn towards the rod 8 associated therewith. The rods 8 intersect the diametrical horizontal plane in which the bolts 5 extend.

The figures show preferred embodiments in which the rods 8 are vertical and thus perpendicular to the horizontal diametrical plane of the logs.

In a variant, the rods 8 could slope relative to the diametrical horizontal plane, but in any event they intersect it, i.e. they are not parallel to the bolts 5.

FIG. 1 shows a first embodiment in which each bolt 5 is associated with a single vertical metal rod 8 which is placed in the vertical diametrical plane of the logs 3.

FIGS. 2 and 3 are cross-sections through FIG. 1. In this example, the rods 8 are carriage bolts The head 8*a* of each bolt and the nut 8*b* screwed onto the bolt are each received in recesses formed in the log to prevent them from projecting outside the log. The bolt 8 is received in a bore drilled through the log.

When a traction force is exerted on the rail, the bolts 5 bear against the rods 8 which in turn bear against the wood and thus spread out the force so that the wood fibers situated in the vertical diametrical plane also participate in providing traction strength. Further, under load, each rod 8 tends to curve which has the effect of pressing its head 8*a* and its nut 8*b* against the wood, thereby compressing the wood and this compression force causes a large fraction of the wood fibers to hold together so that they also participate in providing strength to the wood.

Statistical testing has shown that the traction strength of rails equipped with metal rods 8 is more than doubled relative to the strength of the same rails without rods 8. In addition, the dispersion of the results is considerably reduced, with the standard deviation being of the order of 5% about the mean strength.

FIGS. 4 and 5 are respectively a perspective view and a cross-section through a second embodiment in which the end-to-end assembly of two logs is reinforced by four vertical bolts or rods 8 forming two symmetrical pairs about the vertical diametrical plane of the logs, with each pair being in contact or in the immediate proximity of one of the two bolts 5 passing through each of the logs and with all of them being on the same side thereof as the end of the closest log.

FIGS. 6 and 7 are respectively a perspective view and a cross-section through a third embodiment of the invention.

In this embodiment, the end-to-end connection of the ends of two logs 3 is reinforced by six vertical bolts or rods 8, i.e. three rods per log, namely a pair of rods $8_1$ and $8_2$ which are placed in contact with or in the immediate proximity of one of the two bolts $5_1$, symmetrically about the vertical diametrical plane, and a single rod $8_3$ which is placed in contact with or in the immediate proximity of the second bolt $5_2$ which is preferably the bolt closest to the join between the two logs, and said single rod extends in the vertical diametrical plane.

FIGS. 8 and 9 are respectively a perspective view and a cross-section through a fourth embodiment of the invention. In this example, each connection between the ends of two logs is reinforced by eight vertical bolts or rods $8_1$, $8_2$, $8_3$, and $8_4$, i.e. four rods passing through each log. These four rods constitute two pairs of rods, with each pair being in contact with or in the immediate proximity of one of the two bolts $5_1$ and $5_2$, and with the rods in each pair being disposed symmetrically about the vertical diametrical plane.

Advantageously, the distance between the two rods $8_1$ and $8_2$ in one of the pairs is different from the distance between the two rods $8_3$ and $8_4$ in the other pair, such that forces are spread out over a larger portion of the cross-sectional area of the log and stresses in the wood are reduced.

Advantageously, the two rods $8_3$ and $8_4$ of the pair of rods closest to the join between the two logs are closer together than the other two rods $8_1$ and $8_2$. In order to clarify the drawing, the rods 8 are represented in FIG. 9 merely by their axes.

FIGS. 10 and 11 are respectively a perspective view and a cross-section through another embodiment of a guardrail in accordance with the invention. In this example, the traction strength of the guardrail is reinforced by fitting the guardrail with two identical rails 2 and 2' which are superposed and interconnected such that their traction strengths combine. Each rail is constituted by logs connected end-to-end.

The adjacent ends of two logs 3 constituting the same rail are connected together by means of two straps which are interconnected by four horizontal bolts 5 or 5'.

The two straps $4_1$ and $4'_1$ situated on the road side are identical to those used in the embodiments shown in FIGS. 1 to 9 but including only one rail. The assembly is reinforced by vertical metal bolts or rods 10 which are incorporated in the logs and are placed in contact with or in the immediate vicinity of the bolts 5 and 5' by being received in vertical bores drilled in advance through the logs.

FIGS. 10 and 11 show an embodiment in which each bolt 5 and 5' is associated with a single metal rod 10 running along the vertical diametrical plane.

In this example, each metal rod 10 passes through both of the superposed logs 3 and 3' and thus constitutes a mechanical link between the two superposed rails causing them to act together in the event of a traction force being exerted on one only of the two rails.

However, it is often difficult to engage a single rod through both superposed logs since the vertical bores prepared therethrough are often not properly aligned after assembly.

That is why the end-to-end assembly of the two rails includes a single backplate 9 which replaces the two back straps $4_2$ and $4'_2$, and which is connected by the bolts 5 and 5' to the two front straps $4_1$ and $4'_1$.

The plate 9 is the same length as the straps $4_1$ and $4'_1$. Its height is slightly greater than the distance between the two horizontal diametrical planes of the rails. The plate 9 has the effect of reinforcing the mechanical link between the two superposed rails.

In the embodiments of FIGS. 10 to 13, comprising two superposed rails which may or may not be interconnected by assembly means independent from that used at the ends, the impact resistance of the rails is improved such that it is possible to use logs which are longer, thereby reducing the number of connections between logs.

However, as a safety precaution, an additional post 11 is then disposed between each pair of posts 1 carrying the joins between logs.

The additional post 11 may include a mechanical connection to the rails. It serves as a bearing point for these rails in the event of a vehicle striking the rails.

Figure 13:
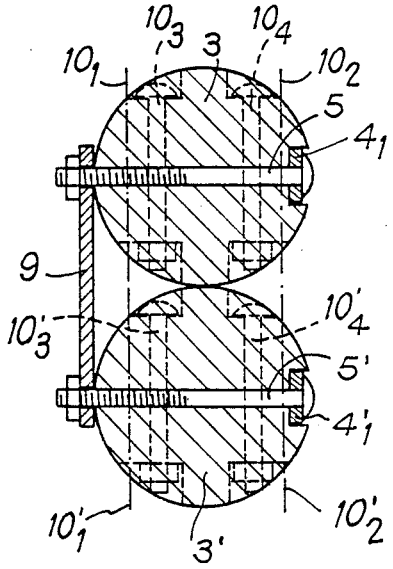

FIGS. 12 and 13 are respectively a perspective view and a cross-section through a second embodiment of a guardrail comprising two superposed rails 2 and 2' which are interconnected by plates 9 serving as common straps in the end-to-end interconnections of both of the rails.

By way of example, FIGS. 12 and 13 show a plate 9 whose inside face includes metal spikes 7 which penetrate into the wood.

The embodiment of FIGS. 12 and 13 differs from that of FIGS. 10 and 11 by the number of reinforcing rods which are used, and in this case each log end has two pairs of vertical rods $10_1$, $10_2$, $10_3$, and $10_4$ instead of only two rods 10.

Another difference lies in the fact that the rods are limited in height to a height corresponding to a single log such that the rods $10_1$, $10_2$, $10_3$, and $10_4$ reinforcing one of the logs are separate from the rods $10'_1$, $10'_2$, $10'_3$, and $10'_4$ reinforcing the log placed immediately beneath the preceding log (as can be seen in FIG. 13), thereby avoiding the need to engage a single rod in two bores which may be misaligned.

In this example, the mechanical connection between the two superposed rails is provided solely by the backplates 9.

Naturally, when a guardrail comprises two superposed rails, it is also possible to make use of metal reinforcing rods 10 which are disposed in configurations as shown in the examples of FIGS. 2 to 7.

Figure 14:
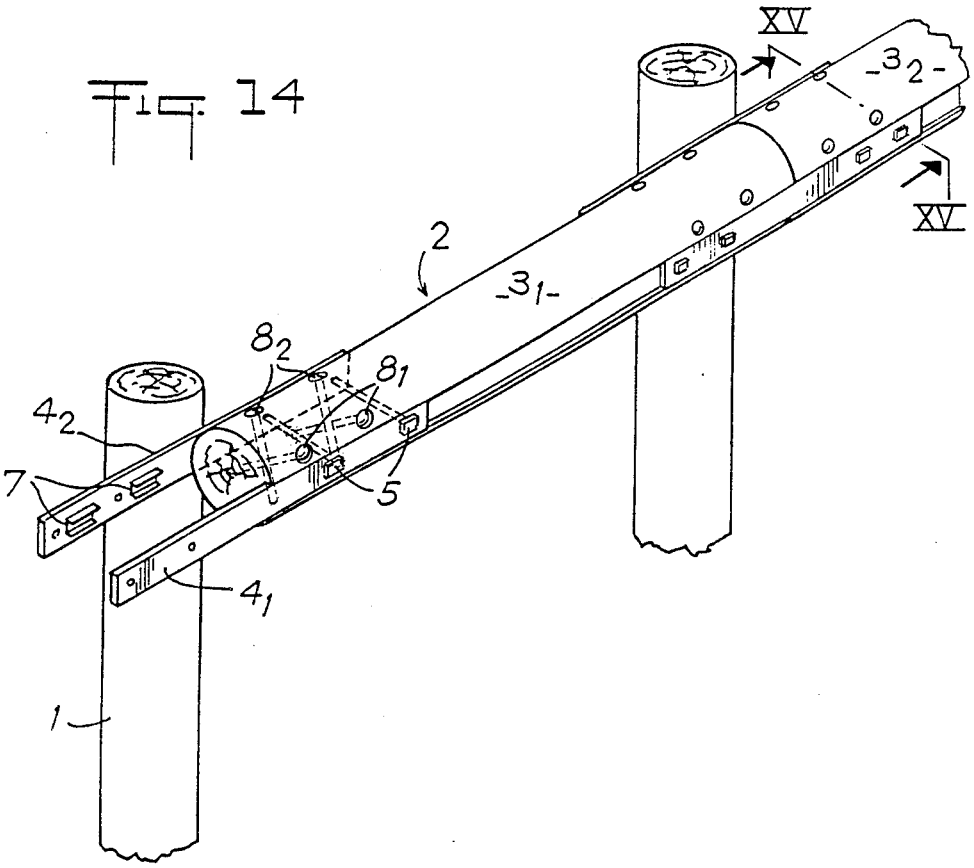
FIGS. 14 and 15 are respectively a perspective view and a cross-section through a fifth embodiment of a guardrail in accordance with the invention and comprising a single horizontal rail.
Figure 15:
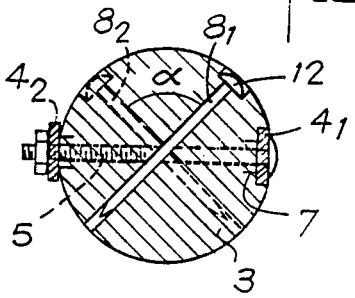

FIGS. 14 and 15 show another embodiment of a guardrail in accordance with the invention. Portions which are similar to those shown in FIGS. 1 and 2 have the same references. In this embodiment, each assembly bolt 5 is associated with two reinforcing rods $8_1$ and $8_2$ which are not vertical, but which are, instead, symmetrically inclined relative to the horizontal diametrical plane of the logs and which are at an angle $\alpha$ relative to each other, which angle may lie, for example, in the range 30° to 60°. The rods $8_1$ and $8_2$ intersect the horizontal plane in which the assembly bolts 5 are located. The two rods $8_1$ and $8_2$ associated with a single bolt are offset longitudinally relative to one another and they are both situated on the same side of the bolts 5 as the join between two logs. FIG. 15 shows two reinforcing logs $8_1$ and $8_2$ in the form of smooth rods each including merely a head 12 which prevents it from dropping away. The head 12 is engaged in a recess formed in the log such that the presence of the rods $8_1$ and $8_2$ does not give rise to any portion which projects outside the logs.

This embodiment shows that the reinforcing rods of the invention may be oblique relative to the horizontal plane, and need not clamp the wood, thus illustrating a difference compared with rods intended for clamping two reinforcing plates applied against the top and bottom faces of a rail.

We claim:

1. A road safety guardrail comprising vertical wood posts carrying at least one horizontal rail made up of wood logs, said logs having a vertical and an horizontal diametrical plane, said logs being interconnected end to end by pairs of metal straps, said straps being interconnected by bolts, wherein each log interconnection includes a pair of vertical metal rods associated with at least one of its bolts, with said rods being symmetrically disposed about the vertical diametrical plane of said logs, each of said bolts passing through each pair of straps and one of said logs, said bolts lying in said horizontal diametrical plane of the logs, said metal rods being further incorporated in each log reinforcing each connection between two logs, said metal rods being vertical and perpendicular to said horizontal diametrical plane, each of said metal rods passing through the log and being placed in the immediate proximity of one of said bolts, on the same side (s) of said bolt as the closest join between two logs, said rods intersecting said horizontal diametrical plane of the logs in which said bolts are lying and having two ends which are received in recesses formed in the log to prevent them from projecting outside the log.

2. A road safety guardrail comprising wood posts carrying two superimposed horizontal rails made up of wood logs having a vertical and an horizontal diametrical plane, said logs being connected end-to-end by pairs of metal straps, said straps being interconnected by bolts, each of said bolts passing through each pair of straps and one of said logs, said bolts lying in the horizontal diametrical plane of the logs, wherein each connection between two successive logs is reinforced by incorporating metal rods in each log, said rods passing through the log and being placed at least in the immediate proximity of said bolts on the same side of the bolts as the closest join between logs, said rods intersecting said horizontal diametrical plane, said two superimposed horizontal rails being in contact with each other and wherein, on the side facing away from the road, the ends of the four logs constituting the two superimposed rails are interconnected in pairs by a common metal plate, said plate being connected by the horizontal bolts to two horizontal straps situated on the road side of the rails.

3. A road safety guardrail comprising vertical wood posts carrying at least one horizontal rail made up of wood logs, said logs having a vertical and an horizontal diametrical plane, said logs being interconnected end to end by pairs of metal straps, said straps being interconnected by bolts, each of said bolts passing through each pair of straps and one of said logs, said bolts lying in said horizontal diametrical plane of the logs, metal rods incorporated in each log reinforcing each connection between two logs, each of said metal rods passing through the log and being placed in the immediate proximity of one of said bolts, on the same side (s) of said bolt as the closest join between two logs, said rods intersecting said horizontal diametrical plane of the logs in which said bolts are lying and having two ends which are received in recesses formed in the log to prevent them from projecting outside the log, wherein said metal rods are vertical and perpendicular to said horizontal diametrical plane and wherein said metal rods further include at each log end, a vertical rod associated with one of its bolts and placed in the vertical diametrical plane of the log, and two vertical rods associated with the other bolt and disposed symmetrically about the vertical diametrical plane of the log.

4. A road safety guardrail comprising vertical wood posts carrying at least one horizontal rail made up of wood logs, said logs having a vertical and an horizontal diametrical plane, said logs being interconnected end to end by pairs of metal straps, said straps being interconnected by bolts, each of said bolts passing through each pair of straps and one of said logs, said bolts lying in said horizontal diametrical plane of the logs, metal rods incorporated in each log reinforcing each connection between two logs, each of said metal rods passing through the log and being placed in the immediate proximity of one of said bolts, one the same side (s) of said bolt as the closest join between two logs, said rods intersecting said horizontal diametrical plane of the logs in which said bolts are lying and having two ends which are received in recesses formed in the log to prevent them from projecting outside the log, wherein said metal rods are vertical and perpendicular to said horizontal diametrical plane and wherein said metal rods further comprise for each log, a pair of vertical metal rods placed at least in the immediate proximity of one of the bolts, and a second pair of vertical rods placed at least in the immediate vicinity of the second bolt, with the distance between the two rods of one of the pairs being different from the distance between the two rods of the other pair.

5. A road safety guardrail comprising vertical wood posts carrying at least one horizontal rail made up of wood logs, said logs having a vertical and an horizontal diametrical plane, said logs being interconnected end to end by pairs of metal straps, said straps being interconnected by bolts, each of said bolts passing through each pair of straps and one of said logs, said bolts lying in said horizontal diametrical plane of the logs, metal rods incorporated in each log reinforcing each connection between two logs, each of said metal rods passing through the log and being placed in the immediate proximity of one of said bolts, on the same side (s) of said bolt as the closest join between two logs, said rods intersecting said horizontal diametrical plane of the logs in which said bolts are lying and having two ends which are received in recesses formed in the log to prevent them from projecting outside the log, wherein said metal rods further comprise two metal rods associated with each assembly bolt, which rods are inclined and disposed symmetrically about said horizontal diametrical plane.

6. A road safety guardrail comprising vertical wood posts carrying at least one horizontal rail made up of wood logs, said logs having a vertical and an horizontal diametrical plane, said logs being interconnected end to end by pairs of metal straps, said straps being interconnected by bolts, each of said bolts passing through each pair of straps and one of said logs, said bolts lying in said horizontal diametrical plane of the logs, metal rods incorporated in each log reinforcing each connection between two logs, each of said metal rods passing through the log and being placed in the immediate proximity of one of said bolts, on the same side (s) of said bolt as the closest join between two logs, said rods intersecting said horizontal diametrical plane of the logs in which said bolts are lying and having two ends which are received in recesses formed in the log to prevent them from projecting outside the log, said guardrail comprising two superimposed horizontal rails which are in contact with each other and which are constituted by wooden logs connected end-to-end by straps and by bolts, wherein on the side facing away from the road, the ends of the four logs constituting the two superposed rails are interconnected in pairs by a common metal plate which is connected by the horizontal bolts to two horizontal straps situated on the road side of the rails.

7. A safety guardrail according to claim 6, wherein the metal rods pass through two superposed logs of said superposed rails.

8. A safety guardrail according to claim 6, in which said straps and said metal plates include metal spikes on their inside faces which penetrate into said logs.

9. A road safety guardrail comprising vertical wood posts carrying at least one horizontal rail made up of wood logs having a vertical and an horizontal diametrical plane, said logs being interconnected end to end by pairs of metal straps and by bolts, each of said bolts passing through each pair of straps and one of said logs, said bolts lying in the horizontal diametrical plane of the logs, metal rods incorporated in each log reinforcing each connection between two logs, each of said metal rods passing through the log and being placed in the immediate proximity of one of said bolts, on the same side of said bolt as the closest join between two logs, and said metal rods further consists of two pairs of vertical rods, a first pair of vertical rods placed in the immediate proximity of one of the two bolts and a second pair of vertical rods placed in the immediate proximity of the second bolt, the distance between the two rods of one of the pairs being different from the distance between the two rods of the other pair.

* * * * *